US005252945A

United States Patent [19]

Dohnishi

[11] Patent Number: 5,252,945

[45] Date of Patent: Oct. 12, 1993

[54] HIGH-VOLTAGE ELECTRONIC PARTS

[75] Inventor: Kiyoyuki Dohnishi, Nagaokakyo, Japan

[73] Assignee: Murata Manufacturing Co., Ltd., Japan

[21] Appl. No.: 905,806

[22] Filed: Jun. 29, 1992

[30] Foreign Application Priority Data

Jun. 28, 1991 [JP] Japan ..... 3-185268

[51] Int. Cl.[5] ..... H01C 13/00

[52] U.S. Cl. ..... 338/334

[58] Field of Search ..... 338/334, 325, 48, 320; 361/275, 328

[56] References Cited

U.S. PATENT DOCUMENTS 3,668,600 6/1972 Schuberth et al. ..... 338/320

*Primary Examiner*—Marvin M. Lateef

*Attorney, Agent, or Firm*—Ostrolenk, Faber, Gerb & Soffen

[57] ABSTRACT

A voltage-dividing resistor plate is stored in a case, and a resin layer for insulation is formed on the voltage-dividing resistor plate. On the resin layer, for example, a coupling capacitor and a smoothing capacitor are affixed. And it is so arranged that the potential of the electrode of the coupling capacitor on the side of the voltage-dividing resistor plate is equal to the potential of the voltage-dividing resistor plate where the coupling capacitor is affixed. It is also so arranged that the potential of the electrode of the smoothing capacitor on the side of the voltage-dividing resistor plate is equal to the potential of the voltage-dividing resistor plate where the smoothing capacitor is affixed.

7 Claims, 2 Drawing Sheets

HIGH-VOLTAGE ELECTRONIC PARTS

BACKGROUND OF THE INVENTION

1. Field of the Invention

The present invention relates to a high-voltage electronic part, in particular, to a high-voltage block for supplying voltage to a focusing electrode of a CRT, and if necessary for supplying voltage to a screen electrode of a CRT.

2. Description of the Prior Art

For supplying voltage to a focusing electrode of a CRT, a high-voltage electronic part such as a high-voltage block is used. With such a high-voltage electronic part, a voltage-dividing resistor is used for division of the voltage from a flyback transformer. The voltage-dividing resistor is stored in a case. In this case, there are also stored a coupling capacitor, which is used for overlapping dynamic focusing voltage on output divided by the voltage-dividing resistor, and a smoothing capacitor for smoothing output from the voltage dividing resistor for focusing.

However, since the voltage supplied with such a high-voltage electronic part is high, an adequate distance is required between the voltage-dividing resistor and the capacitor when the insulation and the influence of the induced ripples are taken into consideration. Therefore, it is difficult to miniaturize the high-voltage electronic part. Furthermore, since the high-voltage electronic part can not be miniaturized, influence induced by heat is large, and there are problems about its reliability e.g. risk of deformation thereof.

SUMMARY OF THE INVENTION

Therefore, the primary object of the present invention is to provide a high-voltage electronic part which can be miniaturized and has a high reliability.

The present invention relates to a high-voltage electronic part comprising a case, a voltage-dividing resistor stored in the case and a capacitor stored in the case and connected to the voltage-dividing resistor, wherein the capacitor is located at a position where the potential of an electrode of the capacitor on the side of the voltage-dividing resistor is equal to the potential in the potential gradient of the voltage-dividing resistor.

Since the potential of the electrode of the capacitor on the side of voltage-dividing resistor is then equal to the potential of the voltage-dividing resistor where the capacitor is located, the distance required for insulation between the voltage-dividing resistor and the capacitor can be reduced.

According to the present invention, since the distance between the voltage-dividing resistor and the capacitor can be reduced, the high-voltage electronic part can be miniaturized. Therefore, influence induced by heat is reduced, and risk of deformation of the high-voltage electronic part is reduced, resulting in increased reliability of the high-voltage electronic part.

The aforementioned object and other objects, features, phases and advantages of the present invention will become more apparent from the following description with reference to the accompanying drawings.

DESCRIPTION OF THE PREFERRED EMBODIMENTS

Figure 1:
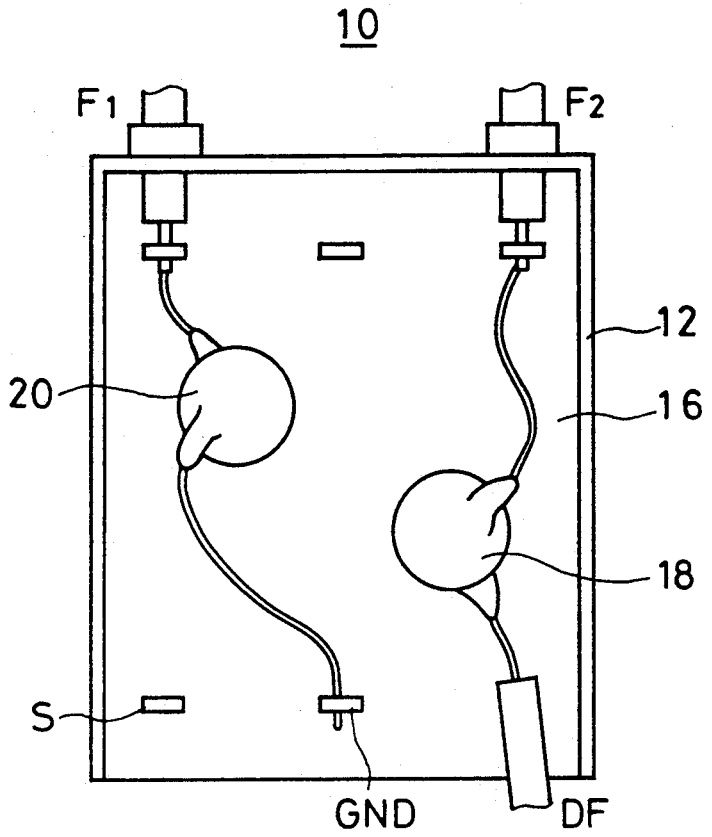
FIG. 1 is an illustratory plan view of an embodiment of the present invention.
Figure 2:
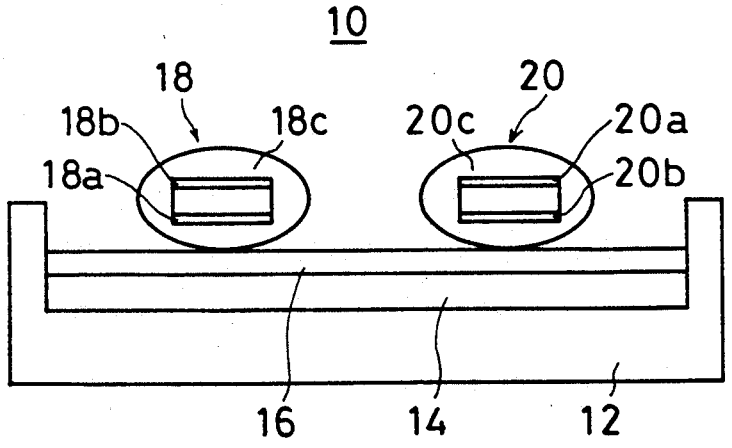
FIG. 2 is an illustratory side view of a high-voltage electronic part shown in FIG. 1.

FIG. 1 is an illustratory plan view of an embodiment of the present invention, and FIG. 2 is an illustratory side view thereof. A high-voltage electronic part 10 includes a case 12. A voltage-dividing resistor plate 14 is stored in the case 12. On the voltage-dividing resistor plate 14, a resin layer 16 of such as epoxy resin is formed. A coupling capacitor 18 for overlapping dynamic focusing voltages and a smoothing capacitor 20 are affixed on the resin layer 16. The coupling capacitor 18 comprises a disc of dielectric with electrodes **18*a* and 18*b* formed on both sides of the disk, and an insulating cover material 18*c* formed around the disk. Similarly the smoothing capacitor 20 comprises a disc of dielectric with electrodes 20*a* and 20*b* formed on both sides of the disk, and an insulating cover material 20*c*** formed around the disk.

Figure 3:
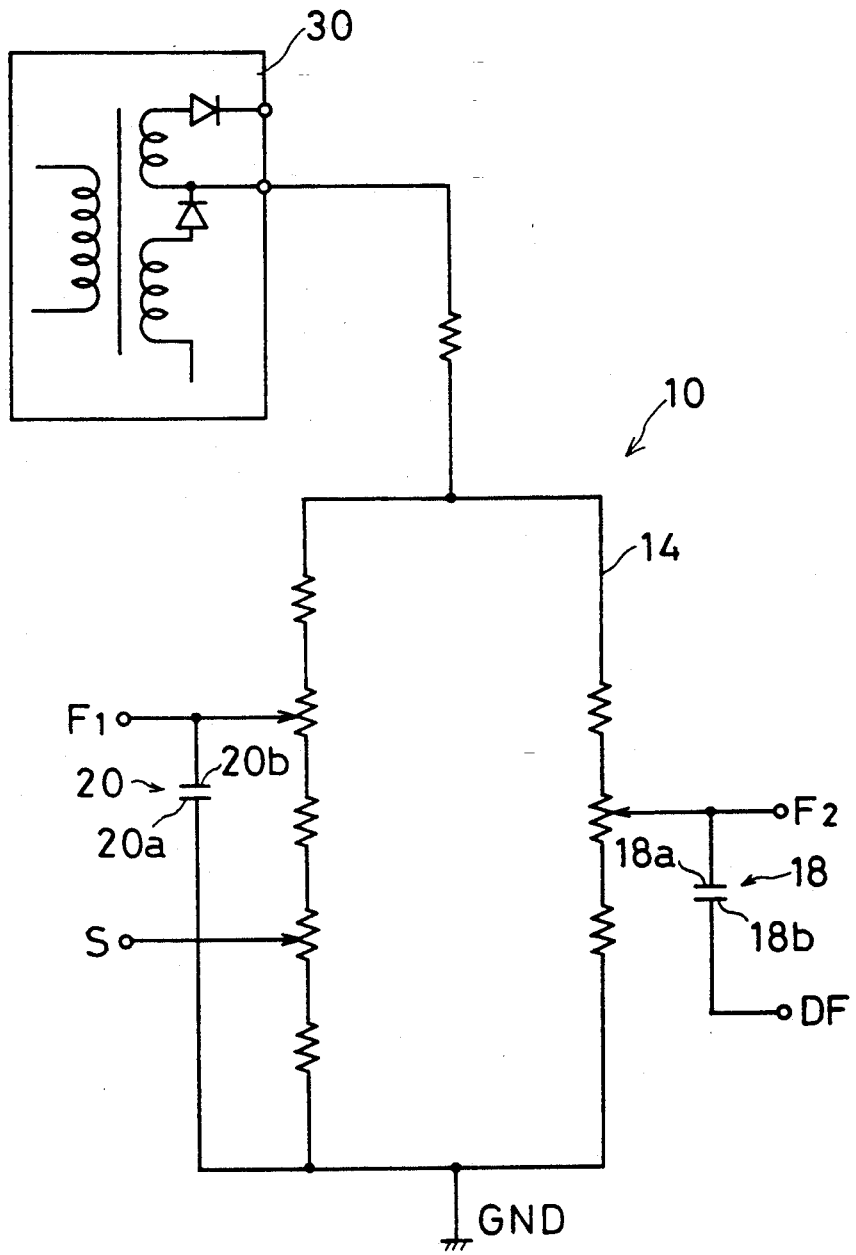
FIG. 3 is a circuit diagram of the high-voltage electronic part shown in FIG. 1.

The high-voltage electronic part 10 is connected to form a circuit shown in FIG. 3. One end of the voltage-dividing resistor plate 14 is connected to a flyback transformer 30, while the other end thereof is grounded. The voltage from the flyback transformer 30 is divided by the voltage-dividing resistor plate 14. The midpoint of the voltage-dividing resistor plate 14 is connected to a focusing output end $F_1$. The smoothing capacitor 20 is connected between the focusing output end $F_1$ and the ground GND. Therefore, DC focusing output is obtained from the focusing output end $F_1$.

The midpoint of the voltage-dividing resistor plate 14 is connected to the other dynamic focusing output end $F_2$. A dynamic focusing voltage circuit DF is connected to the dynamic focusing output end $F_2$ via the coupling capacitor 18. The dynamic focusing voltage from the dynamic focusing voltage circuit DF is overlapped via the coupling capacitor 18 on the voltage from the voltage-dividing resistor plate 14. Therefore, from the dynamic focusing output end $F_2$, the dynamic focusing output representing the voltage from the voltage-dividing resistor plate 14 overlapped by the dynamic focusing voltage can be obtained.

These focusing output and dynamic focusing output are supplied to two focusing electrodes of a CRT. In the figure, S designates a screening output end, and the screening output from the screening output end S is supplied to the screening electrode of a CRT.

In the high-voltage electronic part 10, the electrode **18*a* on the lower voltage side of the coupling capacitor 18 is located on the side of the voltage-dividing resistor plate 14, while the electrode 18*b* on the higher voltage side of the coupling capacitor 18 is located on the opposite side of the voltage-dividing resistor plate 14. That is, it is so arranged that, in the electrodes 18*a* and 18*b* of the coupling capacitor 18, the electrode 18*a* connected to the dynamic focusing output end $F_2$ is located on the side of the voltage-dividing resistor plate 14. Then, a potential gradient is formed in the voltage-dividing resistor plate 14 between the flyback transformer 30 and the ground GND. And the coupling capacitor 18 is so located at a position where the potential of the electrode 18*a* on the lower voltage side is equal to the potential of the voltage-dividing resistor plate 14**.

In the high-voltage electronic part 10, the electrode 20*b* on the higher voltage side of the smoothing capacitor 20 is located on the side of the voltage-dividing resistor plate 14, while the electrode 20*a* on the lower voltage side of the smoothing capacitor 20 is located on the opposite side of the voltage-dividing resistor plate 14. That is, it is so arranged that, in the electrodes 20*a* and 20*b* of the smoothing capacitor 20, the electrode 20*b* connected to the focusing output end $F_1$ is located on the side of the voltage-dividing resistor plate 14. And the smoothing capacitor 20 is so located at a position where the potential of the electrode 20*b* on the higher voltage side is equal to the potential of the voltage-dividing resistor plate 14.

In the high-voltage electronic part 10, the potential of the electrode 18*a* on the lower voltage side of the coupling capacitor 18 is substantially equal to the potential of the position of the voltage-dividing resistor plate 14 where the coupling capacitor 18 is located. Accordingly, no large insulation is required between the electrode 18*a* of the coupling capacitor 18 and the voltage-dividing resistor plate 14, and it is possible to contact the insulating cover material 18*c* with the resin layer 16. Similarly, since the potential of the electrode 20*b* on the higher voltage side of the smoothing capacitor 20 is substantially equal to the potential of the position of the voltage-dividing resistor plate 14 where the smoothing capacitor 20 is located, it is possible to contact the insulating cover material 20*c* with the resin layer 16.

Thus, with the high-voltage electronic part 10, a large distance not required between the individual capacitors 18 and 20 and the resin layer 16. Therefore, the high-voltage electronic part 10 can be miniaturized as compared with the conventional high-voltage electronic part in which the comprising parts had to be separated from each other for sufficient insulation. Since, the high-voltage electronic part 10 can be miniaturized, influence induced by heat is reduced, and the risk of deformation of the high-voltage electronic part is reduced, resulting in increasing reliability of the high-voltage electronic part.

Although the present invention has been described above in detail with reference to the accompanying drawings, it is apparent that this is for the purpose of illustration as an example and is by no means to be taken as limitation and the spirit and scope of this invention are to be limited only by the accompanying claims.

What is claimed is:

1. A high-voltage electronic part comprising:

a case;

a voltage-dividing resistor stored in said case and having a voltage gradient formed therein when said voltage-dividing resistor is connected to a voltage source; and a first capacitor stored in said case and including an electrode connected to said voltage-dividing resistor, wherein said first capacitor is located in said case at a position so that said electrode is arranged adjacent to a portion of said voltage-dividing resistor, and the potential of said electrode of said first capacitor is equal to the potential of said portion of said voltage-dividing resistor adjacent to which said first capacitor is arranged.

2. A high-voltage electronic part according to claim 1, wherein a resin layer for insulation is formed on said voltage-dividing resistor and an insulating cover material is formed around said first capacitor, and said capacitor is so arranged that said resin layer is in contact with said insulating cover material.

3. A high voltage electronic part according to claim 1, further comprising a second capacitor stored in said case and including an electrode connected to said voltage-dividing resistor, wherein said second capacitor is located in said case at a position so that said electrode of said second capacitor is arranged adjacent to a portion of said voltage-dividing resistor, and the potential of said electrode of said second capacitor is equal to the potential of said portion of said voltage-dividing resistor adjacent to which said second capacitor is arranged.

4. A high-voltage electronic part according to claim 3, wherein said first capacitor is for providing a first focusing voltage from said voltage-dividing resistor, and said second capacitor is for providing a second focusing voltage from said voltage-dividing resistor; said first and second capacitors being for supplying said first and second focusing voltages to two focusing electrodes of a CRT.

5. A high-voltage circuit comprising in combination:

the high-voltage electronic part of claim 1;

a flyback transformer, connected to one end of said voltage-dividing resistor, for supplying said voltage to said voltage-dividing resistor; and a ground connected to the other end of said voltage-dividing resistor.

6. A high-voltage electronic part according to claim 3, wherein said electrode of said first capacitor connected to said voltage-dividing resistor is on a lower voltage side of said first capacitor, and said electrode of said second capacitor connected to said voltage-dividing resistor is on a higher voltage side of said second capacitor.

7. A high-voltage electronic part according to claim 4, wherein said first capacitor is a coupling capacitor for providing an overlapping dynamic focusing voltage and said second capacitor is a smoothing capacitor for smoothing said voltage from said voltage-dividing resistor.

* * * * *